United States Patent [19]

Krasle

[11] Patent Number: 4,727,870

[45] Date of Patent: Mar. 1, 1988

[54] HYPERBARIC CHAMBER

[75] Inventor: George E. Krasle, Atlanta, Ga.

[73] Assignee: Hyperbaric Systems, Inc., Atlanta, Ga.

[21] Appl. No.: 872,612

[22] Filed: Jun. 10, 1986

[51] Int. Cl.[4] ..... A61G 10/00

[52] U.S. Cl. ..... 128/202.12; 128/205.26

[58] Field of Search ..... 128/205.26, 202.12, 128/30; 405/192; 114/335, 120, 178; 49/200

[56] References Cited

U.S. PATENT DOCUMENTS

| | | | |
|---|---|---|---|
| 2,383,821 | 8/1945 | Scanlan | 128/30.2 |
| 2,448,546 | 9/1948 | Plemel | 128/205.26 |
| 2,558,220 | 6/1951 | McLachlan | 49/200 |
| 3,316,828 | 5/1967 | Boehmer | 128/205.26 |
| 3,345,985 | 10/1967 | Fisher | 128/205.26 |
| 3,368,556 | 2/1968 | Jensen | 128/205.26 |
| 3,587,574 | 6/1971 | Mercer | 128/205.26 |
| 3,807,656 | 4/1974 | Fletcher et al. | 405/192 |
| 4,227,524 | 10/1980 | Galerne | 128/205.26 |

*Primary Examiner*—Edward M. Coven
*Assistant Examiner*—J. P. Lacyk
*Attorney, Agent, or Firm*—Jones, Askew & Lunsford

[57] ABSTRACT

The present invention comprises an improved hyperbaric chamber for treating patients under superatmospheric conditions. The improved hyperbaric chamber includes an easy to open and close self-sealing hatch and a multipositional gurney that can be adjusted to a sitting or partially sitting position inside the chamber thereby making the patient more comfortable.

5 Claims, 9 Drawing Figures

HYPERBARIC CHAMBER

TECHNICAL FIELD

The present invention relates to an improved hyperbaric chamber for the treatment of medical disorders, and more specifically relates to a chamber with a novel easy-to-open, self-sealing hatch and a mutlipositional gurney for enhanced patient comfort.

BACKGROUND ART

Hyperbaric oxygen treatment is used in the treatment of medical disorders involving the need for increased amounts of oxygen by the human body. Traditionally, hyperbaric oxygen has been used to treat divers suffering from caisson disease, otherwise known as the "bends". A decompression sickness is a condition requiring reduction and reabsorption of trapped nitrogen gas bubbles in the circulatory system by increasing ambient pressure in the patient and facilitating more rapid removal of dissolved nitrogen by slow decrease to normal atmospheric pressure under a 100% oxygen environment.

Various other uses of hyperbaric oxygen treatment have been discovered over the last few years including the treatment of gangrene, carbon monoxide intoxication, skin grafts, decompression sickness, smoke inhalation, Meleney's ulcers and chronic refractory osteomyelitis. Hyperbaric oxygen has also been found effective in treating cancer patients suffering from skin disorders caused by radiation therapy. Many other bodily malfunctions relating to oxygen deficiencies have responded favorably to hyperbaric oxygen treatment alone and in combination with conventional treatments.

Hyperbaric oxygen causes beneficial effects by increasing the delivery of oxygen to the blood and tissues. The increased physical pressure also has been found to have a positive effect on the body. Under normal atmospheric pressure, only a small amount of oxygen is dissolved in the bloodstream. When oxygen is administered at an elevated pressure, a higher alveolar partial pressure of oxygen is achieved because more oxygen is dissolved. This effect combined with the effect of the increased physical pressure leads to physiologic changes including changes in the patient's microcirculation and platelet aggregation, immune mechanism, and bacterial metabolism. For example, many organisms, such as *Clostridium perfringens* that causes gas gangrene, can't survive in high concentrations of oxygen. Hyperbaric oxygen therapy also tends to decrease inflammation, and increase the rate of healing at the sight of an injury. Also, blood vessels appear to grow better at higher oxygen concentrations making skin grafts more successful.

Hyperbaric chambers have been available for many years; however, access to the chamber is often impeded because the patient must climb into the chamber and lie prone or supine within the chamber for extended periods of time while treatment is being administered. Oftentimes treatment is continued for hours or even days. This inability to change position causes discomfort for the patient and may even cause claustrophobia. Thus, there has been a need in the art for a hyperbaric chamber which enables the patient to assume a variety of positions within the chamber.

Typical of the chambers described in the prior art is U.S. Pat. No. 3,368,556. The chamber described in this patent has a door with a complex locking system comprising pivot rods and latching systems. The door is difficult to open and close quickly.

A further disadvantage of hyperbaric chambers in the prior art is pressure leakage. Due to the increased pressure within the chamber, all openings and joints must be sealed to prevent such leakage. The entry hatch is the prime location of pressure leakage. Hyperbaric chambers have utilized a variety of locks and seals to curtail pressure leakage around the entry hatch, but these closures have provided seals which are unsatisfactory.

Finally, the hyperbaric chambers that are described in the prior art all have hatches that are difficult or impossible to open from the inside of the chamber. Thus, there has also been a need in the art for a hyperbaric chamber with a hatch that is both easy to open from inside or outside the chamber. The hatch must also provide an air-tight seal so that a superatmospheric pressure can be maintained within the chamber.

SUMMARY OF THE INVENTION

The present invention provides an improved hyperbaric chamber with a multipositional gurney and a self-sealing entry hatch. the gurney is in a horizontal position when the patient is placed on the gurney. The gurney with the patient positioned thereupon is pushed into the hyperbaric chamber. After the patient is properly positioned in the chamber, the gurney can then be positioned in a partial sitting position thereby making the patient more comfortable. It has been determined that the patient suffers much less from claustrophobia when in a sitting position in the chamber.

After the patient is comfortably positioned in the chamber, the hatch in the improved hyperbaric chamber of the present invention is closed. The hatch mechanism in the present invention is an improvement over hatches in the prior art. The hatch in the improved hyperbaric chamber of the present invention is fitted with a counter weight so that the hatch can be easily swung into either open or closed position with a minimum of effort. In addition, the hatch is constructed so that when the hatch is in the closed position, it is self-sealing. The increased pressure in the chamber causes the hatch to seal itself. Because the hatch seals itself, there is no requirement for sealing latches on the hatch.

Accordingly, it is an object of the present invention to provide an improved hyperbaric chamber with a hatch that is easy to open and close and, at the same time, provides an air-tight seal.

Another object of the present invention is to provide an improved hyperbaric chamber with a gurney that allows a patient to assume various positions within the chamber.

A further object of the present invention is to provide an improved hyperbaric chamber with an entry hatch mechanism that prevents pressure leakage without the need for sealing latches.

A further object of the present invention is to provide an improved hyperbaric chamber that will not cause claustrophobia in the patient.

Another object of the present invention is to provide an improved hyperbaric chamber.

Another object of the present invention is to provide an improved hyperbaric chamber with a hatch connected to a counterweight enabling an attendant quick and easy opening and closing of the hatch.

Other objects, features and advantages of the present invention will become apparent upon reading the following detailed description of the invention, when taken in conjunction with the drawing and the appended claims.

DETAILED DESCRIPTION OF THE DISCLOSED EMBODIMENT

Figure 1:
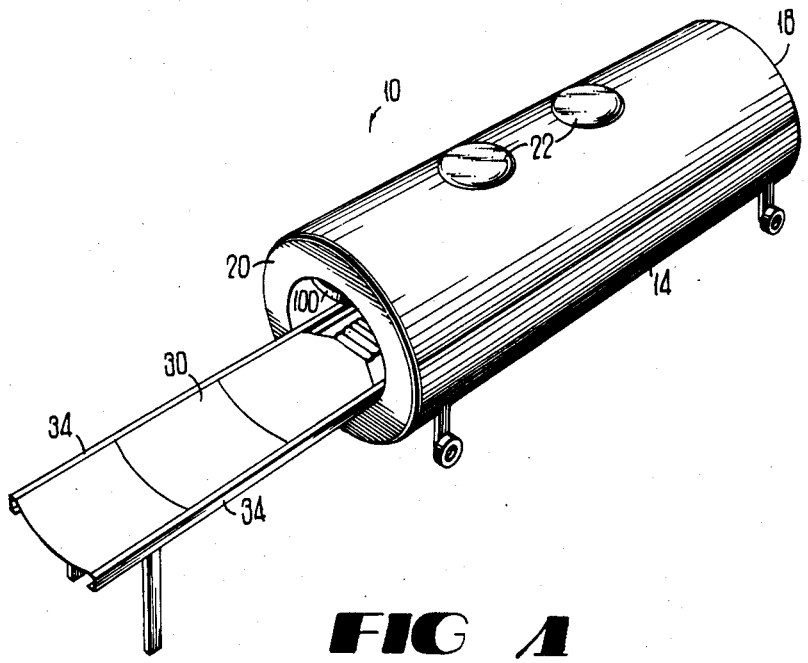
FIG. 1 is a perspective drawing of the present invention with the hatch open and the gurney in a flat position.

The hyperbaric chamber 10 of the present invention includes a housing 14 in the shape of a hollow tube permanently closed at an upper end 18 and open at a lower end 20. The hyperbaric chamber 10 can optionally have one or more windows 22 of varying size so that the patent can read or watch television while in the chamber. The opening at the lower end 20 defines an entry 25 through which a patient enters the housing 14. It is to be understood that the shape of the hyperbaric chamber is not limited to a tube but can be any shape including, but not limited to a cube or sphere.

Figure 3:
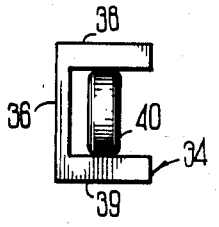
FIG. 3 is an end view of the gurney rails and a wheel fitted therein.

A gurney 30 is mounted on a pair of rails 34 so that the gurney may slidably enter the housing 14 through the entry 25. The rails 34 are formed of three walls, shown best in FIG. 3, attached at right angles. A first vertical wall 36 is attached at its uppermost and lowermost ends to horizontal walls 38 and 39. The horizontal walls 38 and 39 are spaced apart so as to hold a series of wheels 40. The wheels 40 are mounted partially within the frame 50 of the gurney 30. As the gurney 30 is slidably pushed into the housing 14 through the entry 25 the wheels 40 of the gurney rotate within the rails 34 so that the gurney enters the chamber 14 effortlessly. This enables a technician to easily install a patient within the housing 14 for hyperbaric treatment.

The gurney 30 lies flat, as shown in FIG. 1, parallel to the rails, when the patient is being inserted into the housing 14, so that the patient fits through the entry 25. However, after the patient is inserted into the chamber 10, the gurney 30 may be adjusted to assume a bent shape, as shown if FIG. 2, so that the patient may assume a seated or partially seated position. The gurney is bent at hinges 54 by the weight of the patient lying upon the gurney 30 when the locking mechanism 60 is placed in an unlock position.

Figure 4:
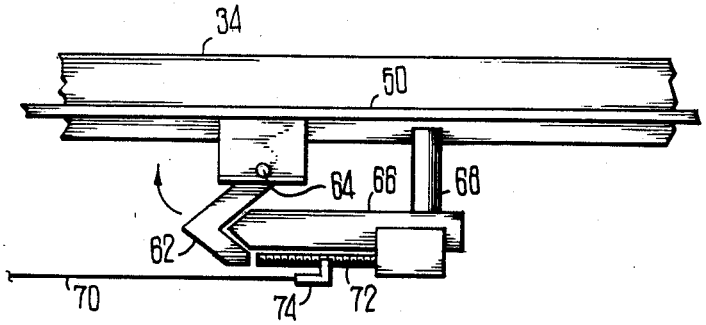
FIG. 4 is a side view of the gurney locking mechanism in locked position.

The locking mechanism 60, shown best in FIG. 4, consists of a latch 62 pivotally mounted on the frame 50 of the gurney 30 at 64 outside of the housing 14. The latch 62 engages a bar 66 which is suspended from the rail 34 by a rod 68 when the locking mechanism 60 is in the locked position as shown in FIG. 4.

Figure 5:
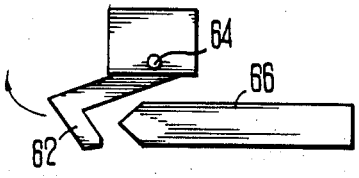
FIG. 5 is the gurney locking mechanism in unlocked position.

The locking mechanism 60 is in the unlocked position when the latch 62 is disengaged from the bar 66, as shown in FIG. 5, in the following manner. A wire 70 is attached at one end to a bolt 72 at 74. The wire is attached at the other end to a handle 80 shown in FIG. 2. A horizontal force placed on the handle 80 in a direction away from the housing 14 moves the bolt 72 reciprocally in a horizontal direction toward the latch 62. With sufficient force placed upon the handle 80, the bolt 72 engages the latch 62 pushing it to a position away the bar 66 as shown in FIG. 5. The latch 62 pivots at 64 in a clockwise direction and remains in that position as long as the force is applied, so that the latch 62 will not engage the bar 66 when the gurney is slid along the rail 34 into the housing 14. A spring, not shown, within the frame 50 of the gurney returns the latch 62 to the locked position when the horizontal force is removed.

Once the locking mechanism has been placed in the unlocked position, the gurney 30 may be slidably inserted into the housing 14 through the entry 25. The entry 25 may then be blocked by the placement of an entry hatch 100 over the entry 25. The housing 14 and the entry hatch 100 should be made of a material, such as metal or plastic, which is impervious to gas such as oxygen or air so that pressurized gas can be introduced into the housing 14 for hyperbaric treatment of a patient lying on the gurney 30 within the housing.

Figure 2:
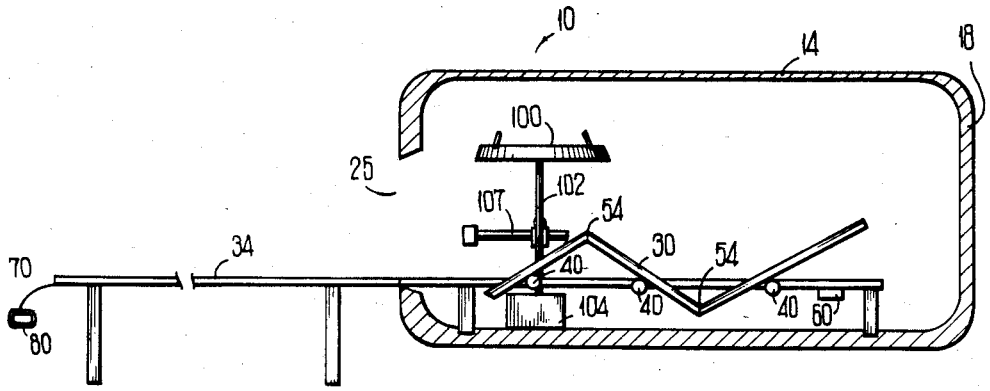
FIG. 2 is a vertical cross sectional view of the present invention with the entry hatch in the open position.
Figure 6:
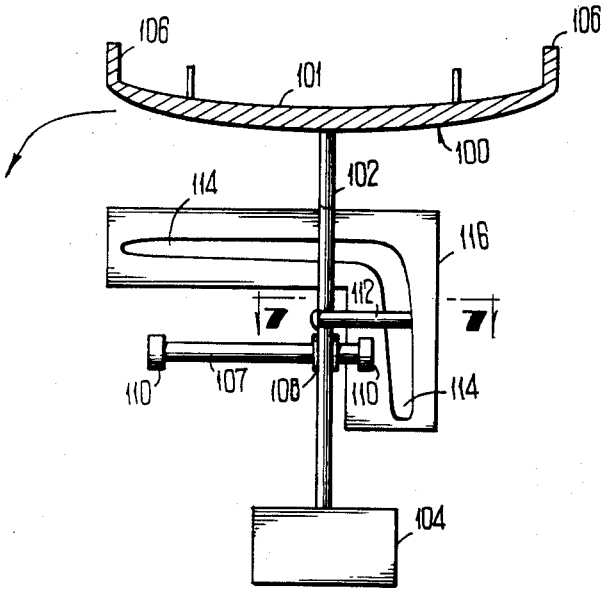
FIG. 6 is a side view of the hatch closing mechanism with the hatch in open position with the hatch shown in cross section.
Figure 9:
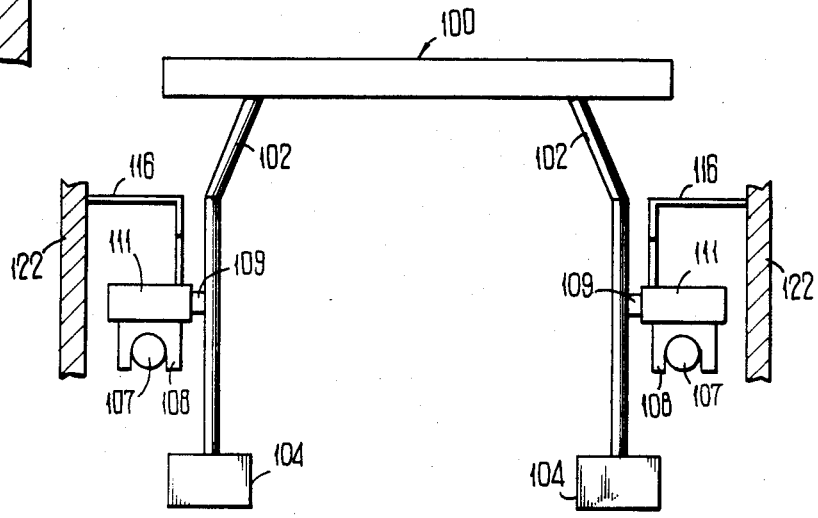
FIG. 9 is a front end view of the hatch and hatch closing mechanism with the hatch in open position.

When the entry hatch 100 is in the open position, as shown in FIG. 2, the hatch 100 is suspended above the entry 25 so that it lies parallel to the rails 34. When the entry hatch is in the open position, it is in an overhead position and is out of the way during entry of the patient. FIG. 6 shows a side view of the hatch closing mechanism. In the preferred embodiment, the mechanisms are weldably attached to either side inside walls of the hyperbaric chamber as best shown in FIG. 9. The hatch 100 is weldably attached to the two hatch brace bars 102. At the other end of each brace bar 102 is a counter balancing weight 104. The counterbalancing weight has a mass sufficient to counter balance the hatch so that the hatch can be rotated in an arcuate path with little effort.

Figure 7:
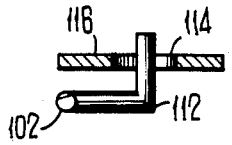
FIG. 7 is a cross-sectional view taken along line 7—7 of FIG. 6.

Referring now to FIG. 6 in which is shown a side view of the hatch closing mechanism, the brace bar 102 is pivotally connected to a U-shaped slide mount 108 at approximately the center of the brace bar 102. The U-shaped slide mount 108 is mounted on the hatch sliding bar 107 so that the hatch 100 counter weight 104 and hatch brace bar 102 assembly can be easily moved horizontally on the hatch sliding bar 107. The hatch sliding bar is weldably attached to the side wall of the hyperbaric chamber by two clamps 110. Attached to the hatch brace bar 102 at approximately the same position as the pivot connection is a hatch guiding means comprising a hatch guide bar 112. As shown in FIG. 7, the hatch guide bar 112 is curved at the end opposite the hatch brace bar attachment so that the curved end slides within the hatch guide slot 114. The hatch guide slot 114 is cut into a metal plate 116 mounted on a side wall 122 of the chamber 10.

Figure 8:
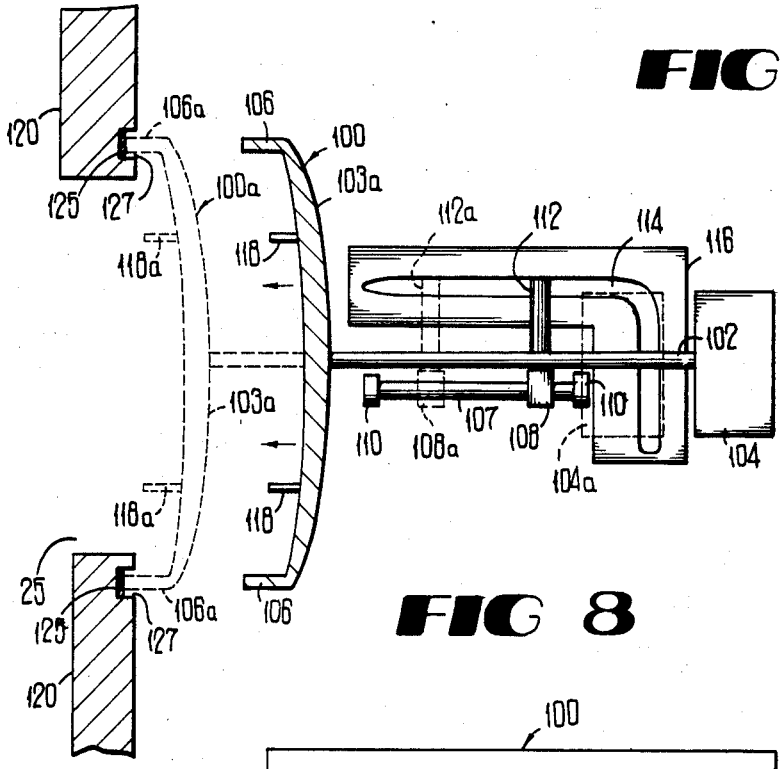
FIG. 8 is a side view of the hatch closing mechanism with the hatch in closed position with the hatch shown in cross section.

As best shown in FIG. 8, to close hatch 100, one grasps the hatch handles 118 and pulls the hatch 100 downwardly so that the hatch travels in a arcuate path. Because the counterweight 104 balances the weight of the hatch 100, the hatch 100 moves downwardly with little effort. The hatch guide bar 112 stops that downward movement of the hatch 100 when the hatch 100 is parallel to the entry in the hyperbaric chamber. When the hatch 100 is parallel to the entry opening 25, the user simply pulls the hatch 100 horizontally into the entry 25 until the hatch engages the entry. The hatch assembly slides on the hatch sliding bar 107 until the hatch 100 fits into the entry as shown in FIG. 8 as a dotted lines 100*a*.

An important feature of the hyperbaric chamber of the present invention is the self-sealing hatch. In FIGS. 6 and 8, the hatch 100 is shown in cross section. Hatch 100 is constructed so the outside surface 101 of the hatch 100 is slightly concave and the inside surface 103 of the hatch 100 is slightly convex. It is to be understood that for normal uses of the hyperbaric chamber wherein the internal pressures will be between 2 and 4 atmospheres, the longitudinal shape of the hatch is not critical. In the preferred embodiment of the improved hyperbaric chamber of the present invention, the hatch has a outwardly protruding ridge 106 attached to the perimeter of the hatch 100. The entry of the hyperbaric chamber 10 has a groove 127 cut into the wall 120 around opening 25. The groove 127 preferably has a sealing gasket 125 inserted into the groove. The sealing gasket 125 is made from neoprene rubber in the preferred embodiment of the present invention. However, any sealing material that is resistant to degradation by oxygen would be suitable. As shown in FIG. 7, when the hatch 100 is closed by pulling the hatch toward the the opening, the ridge 106 engages the groove 127 and forms an airtight seal. Thus, when hatch ridge 106 is fitted into groove 127, the increased gas pressure inside the hyperbaric chamber forces the hatch against the seal thereby increasing the pressure on the gasket 125. The hatch 100 can optionally have a window fitted therein so that the patient can use the window for viewing.

It should be understood, of course, that the foregoing relates only to a preferred embodiment of the present invention and that numerous modifications or alterations may be made therein without departing from the spirit and the scope of the invention as set forth in the appended claims.

I claim:

1. An improved hyperbaric apparatus, comprising:

a chamber having an access opening, said opening defining a sealing surface peripherally located about said opening, said sealing surface located on the inside of said chamber;

a self-sealing hatch assembly within said chamber, said assembly comprising:

an elongate sliding bar having a first and a second end;

clamp means for rigidly mounting said first and second end of said sliding bar to an interior wall of said chamber, such that said bar is spaced a distance away from said interior wall;

a slide mount slidably mounted to said sliding bar along a sliding axis parallel to the longitudinal axis of said sliding bar;

an elongate brace bar having a first and a second end, said brace bar being pivotally mounted to said slide mount at a location intermediate said first and said second end of said brace bar, said brace bar being mounted to said slide mount about a pivoting axis substantially perpendicular to the longitudinal axis of said sliding bar;

a hatch rigidly attached to said first end of said brace bar and configured to mate with said opening of said chamber such that when said hatch is in a closed position relative to said chamber, said hatch encounters said peripheral sealing surface, and said chamber and said hatch define an enclosed cavity;

a counter weight attached to said second end of said brace bar and having a mass such that the center of gravity of the combination of said brace bar, said hatch, and said counter weight is approximately along said pivoting axis;

hatch guiding means for guiding said hatch along a hatch path, said hatch patch including a linear portion and an arcuate portion, said linear hatch path portion being substantially parallel to said sliding axis and extending from said closed position to an intermediate position, and said arcuate hatch path portion extending from said third intermediate position to said second open position, said open position being such that a person may enter and exit said chamber through said opening; and means for increasing gas pressure within said enclosed cavity such that said hatch is encouraged to bias against said peripheral sealing surface, thus sealing said enclosed cavity.

2. The improved hyperbaric apparatus as claimed in claim 1, wherein said arcuate path portion is determined by the pivoting of said hatch about said pivoting axis.

3. The improved hyperbaric apparatus as claimed in claim 1, wherein said hatch guiding means comprises:

a hatch guide bar having a first and a second end, said first end being rigidly attached to said brace bar, and said second end extending along an axis substantially parallel to said pivoting axis; and a plate having primary planar surfaces substantially normal to said pivoting axis, said plate defining a slot configured to accept said guide bar such that as said guide bar is guided along said slot, said hatch is guided along said hatch path.

4. The improved hyperbaric apparatus as claimed in claim 2, wherein said hatch guiding means comprises:

a hatch guide bar having a first and a second end, said first end being rigidly attached to said brace bar, and said second end extending along an axis substantially parallel to said pivoting axis; and a plate having primary planar surfaces substantially normal to said pivoting axis, said plate defining a slot configured to accept said guide bar such that as said guide bar is guided along said slot, said hatch is guided along said hatch path.

5. The improved hyperbaric apparatus as claimed in claim 4, wherein said slot is J-shaped.

* * * * *